US007201305B1

(12) United States Patent
Correa

(10) Patent No.: US 7,201,305 B1
(45) Date of Patent: Apr. 10, 2007

(54) POSTAL OUTGOING AND REPLY ENVELOPE FORM SYSTEM

(76) Inventor: Manuel A. Correa, 3617 Toddsbury La., Olney, MD (US) 20832

( * ) Notice: Subject to any disclaimer, the term of this patent is extended or adjusted under 35 U.S.C. 154(b) by 0 days.

(21) Appl. No.: 09/328,417

(22) Filed: Jun. 9, 1999

Related U.S. Application Data

(60) Provisional application No. 60/120,190, filed on Feb. 16, 1999.

(51) Int. Cl.
*B65D 27/00* (2006.01)

(52) U.S. Cl. ..... 229/69; 229/305

(58) Field of Classification Search ..... 53/284.3, 53/569; 229/68.1, 92.1, 92.3, 300, 307, 313, 229/314, 316, 304, 305, 69; 705/1, 500; 283/116, 100, 103, 108, 111
See application file for complete search history.

(56) References Cited

U.S. PATENT DOCUMENTS

| | | | | | |
|---|---|---|---|---|---|
| 1,200,735 | A | * | 10/1916 | Klein | 229/314 |
| 2,257,766 | A | * | 10/1941 | Sherman | 229/69 |
| 3,133,752 | A | * | 5/1964 | Schumacher | 462/65 |
| 3,211,469 | A | * | 10/1965 | Chamberlain | 229/69 |
| 3,437,259 | A | * | 4/1969 | Steidinger | 229/69 |
| 3,554,438 | A | * | 1/1971 | Van Malderghem | 229/69 |
| 3,802,618 | A | * | 4/1974 | Wiessner | 229/304 |
| 3,837,565 | A | * | 9/1974 | Johnsen | 229/301 |
| 3,905,545 | A | * | 9/1975 | Juszak et al. | 229/69 |
| 3,988,971 | A | | 11/1976 | Steidinger | 93/63 M |
| 4,023,727 | A | * | 5/1977 | Tess | 229/69 |
| 4,081,127 | A | | 3/1978 | Steidinger | 229/69 |
| 4,095,695 | A | | 6/1978 | Steidinger | 206/610 |
| 4,157,759 | A | * | 6/1979 | Dicker | 229/301 |
| 4,425,386 | A | | 1/1984 | Chang | 427/256 |
| 4,461,661 | A | * | 7/1984 | Fabel | 156/70 |
| 4,744,508 | A | * | 5/1988 | Fowler et al. | 229/301 |
| 4,770,337 | A | * | 9/1988 | Leibe | 229/69 |
| 5,011,069 | A | * | 4/1991 | Bowen et al. | 229/69 |
| 5,039,000 | A | * | 8/1991 | Ashby | 229/304 |
| 5,161,735 | A | * | 11/1992 | Bendel | 229/303 |
| 5,163,612 | A | * | 11/1992 | Ashby | 229/301 |
| 5,248,082 | A | * | 9/1993 | Elmlinger | 229/303 |

(Continued)

FOREIGN PATENT DOCUMENTS

EP 0268410 A2 * 5/1988

(Continued)

OTHER PUBLICATIONS

"Making an effective campaign": British Business, Feb. 20, 1987, p. 211.*

(Continued)

*Primary Examiner*—John G. Weiss
*Assistant Examiner*—Michael Fisher

(57) ABSTRACT

A continuous feed, multipart, multilayer form having detachable pin feed edges on each side sized to fit a pin feed impact printer for producing a postal envelope system is disclosed. Each part of the multipart form may have a top sheet, an outgoing envelope, an information sheet and a reply envelope. A series of coatings may be selectively applied to parts of the multipart form so that information impact printed on top sheet produces an addressed and sealable reply envelope, and an information sheet, removably contained within a sealed and addressed outgoing envelope including a postage permit.

27 Claims, 11 Drawing Sheets

Part I, 100

U.S. PATENT DOCUMENTS

| | | | | |
|---|---|---|---|---|
| 5,253,803 | A * | 10/1993 | Chess | 229/305 |
| 5,324,927 | A | 6/1994 | Williams | 235/494 |
| 5,346,123 | A * | 9/1994 | Lombardo | 229/305 |
| 5,989,970 | A * | 11/1999 | Ohkawa et al. | 438/384 |
| 6,136,129 | A * | 10/2000 | Petkovsek | 156/247 |
| 6,409,592 | B1 * | 6/2002 | McCoy et al. | 462/6 |
| 6,505,770 | B1 * | 1/2003 | Correa, Jr. | 229/301 |
| 2004/0050919 | A1 * | 3/2004 | Calonje et al. | 229/306 |

FOREIGN PATENT DOCUMENTS

| | | | |
|---|---|---|---|
| EP | 354758 | A1 * | 2/1990 |
| EP | 0527588 | A1 * | 2/1993 |
| EP | 586061 | A1 * | 3/1994 |
| GB | 2299036 | A * | 9/1996 |

OTHER PUBLICATIONS

One instance of prior use by Transkrit Corp.

Sale and use of an envelope system sold and used in Aug. 1997 for experimental purposes.

Correa, Manuel A., "Inventor's Statement Regarding a Prior Self Mailer", 1997.

* cited by examiner

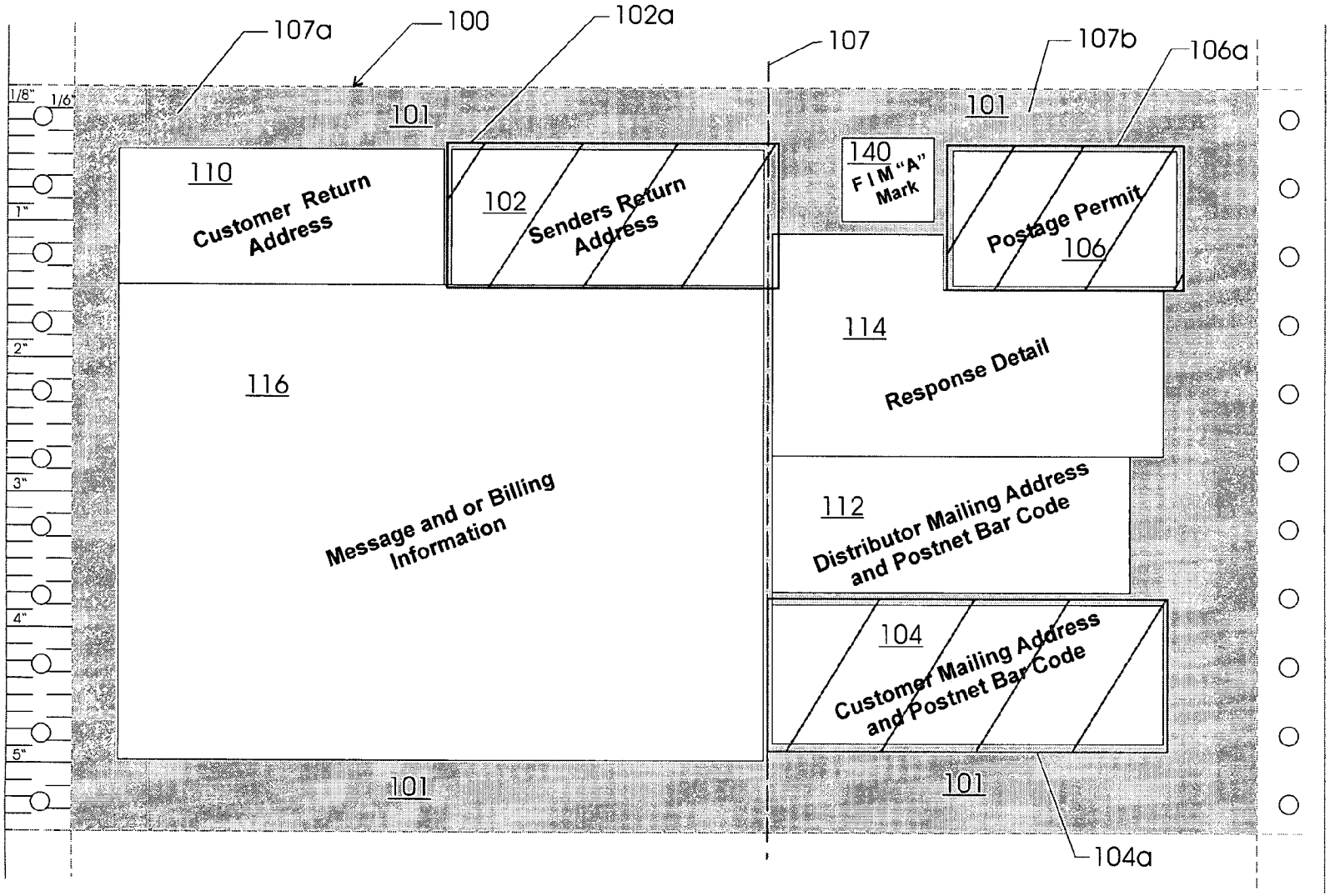
FIG. 2, Part I, 100

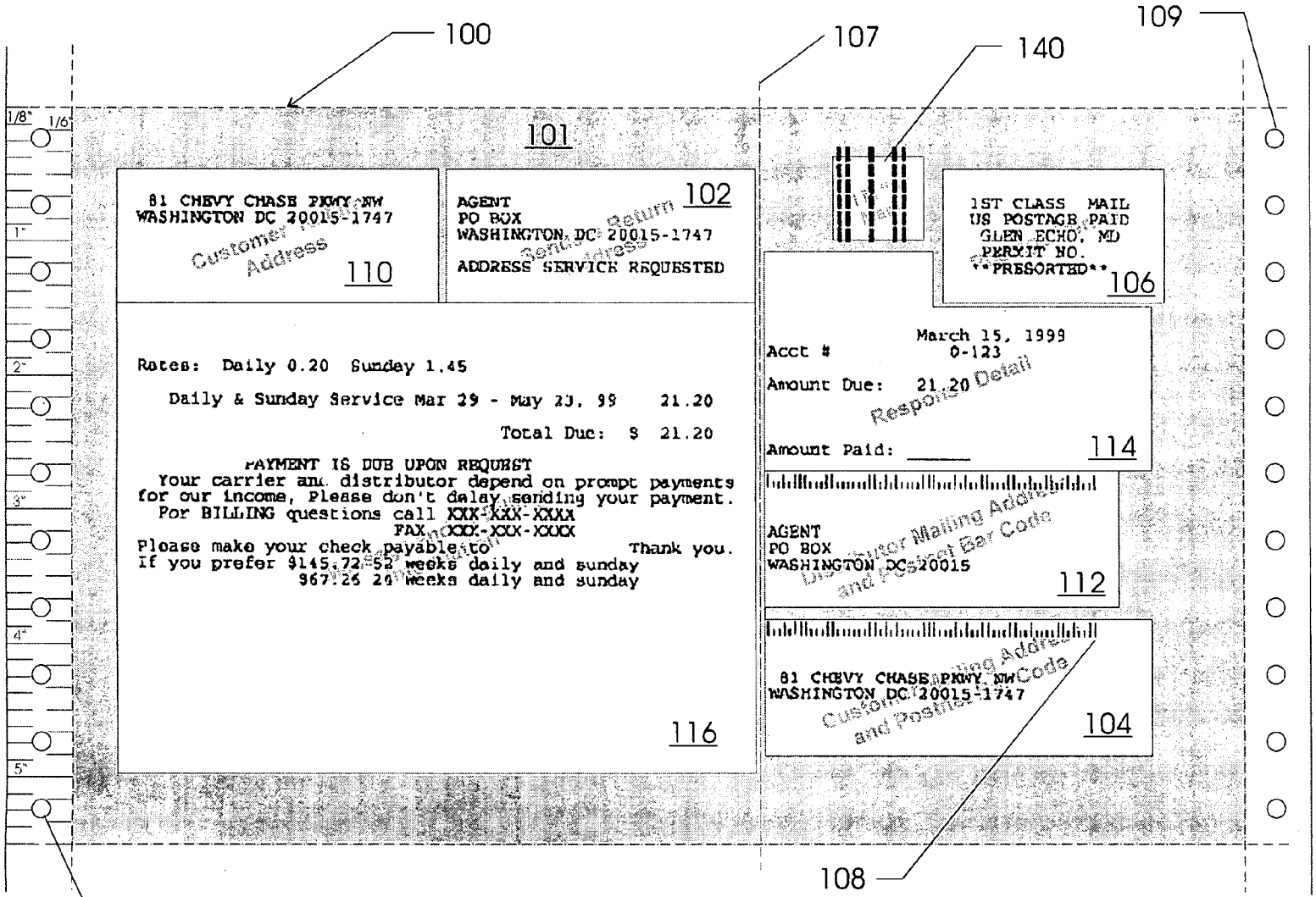
FIG. 3, Part I, 100

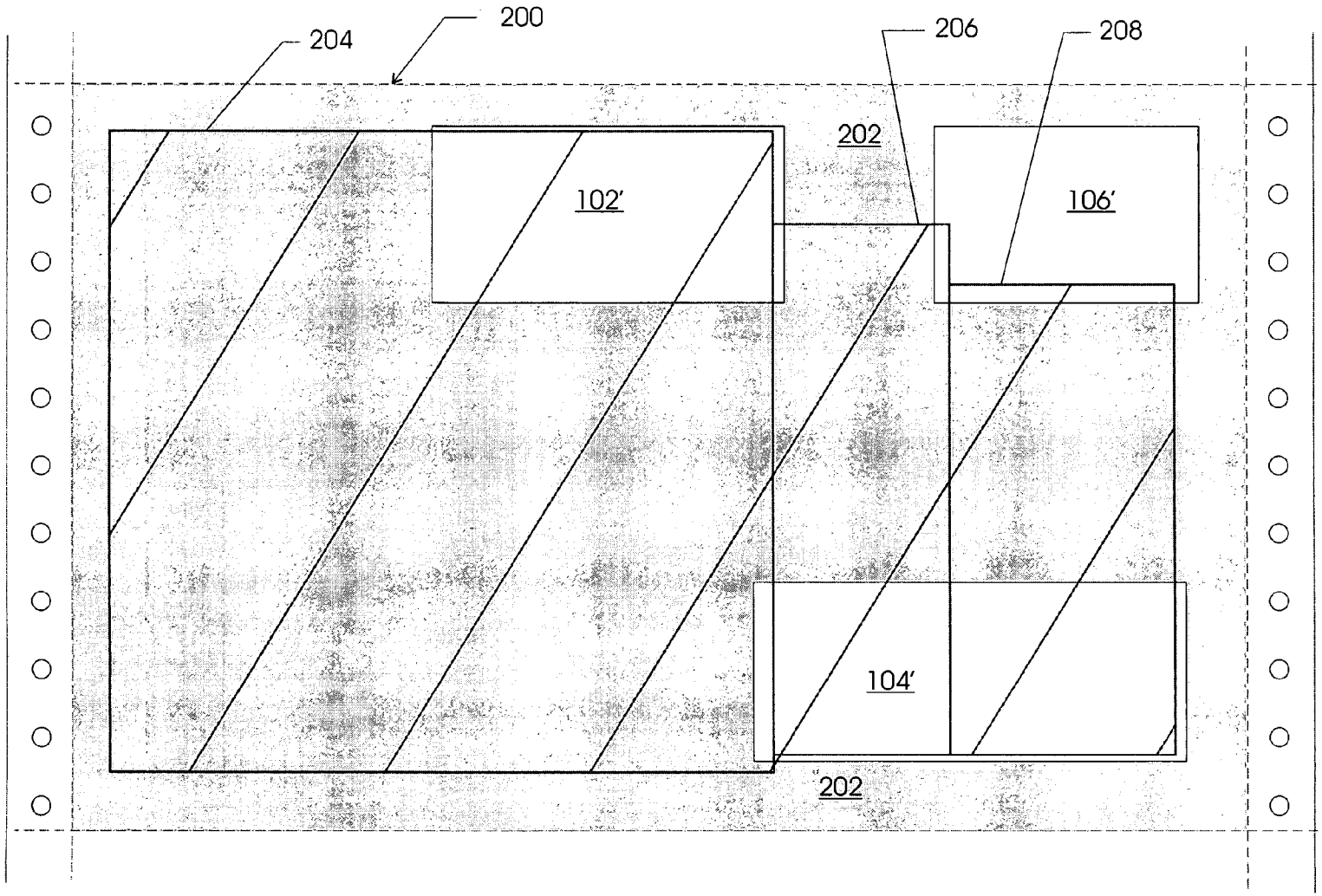
FIG. 4, Part I, 200

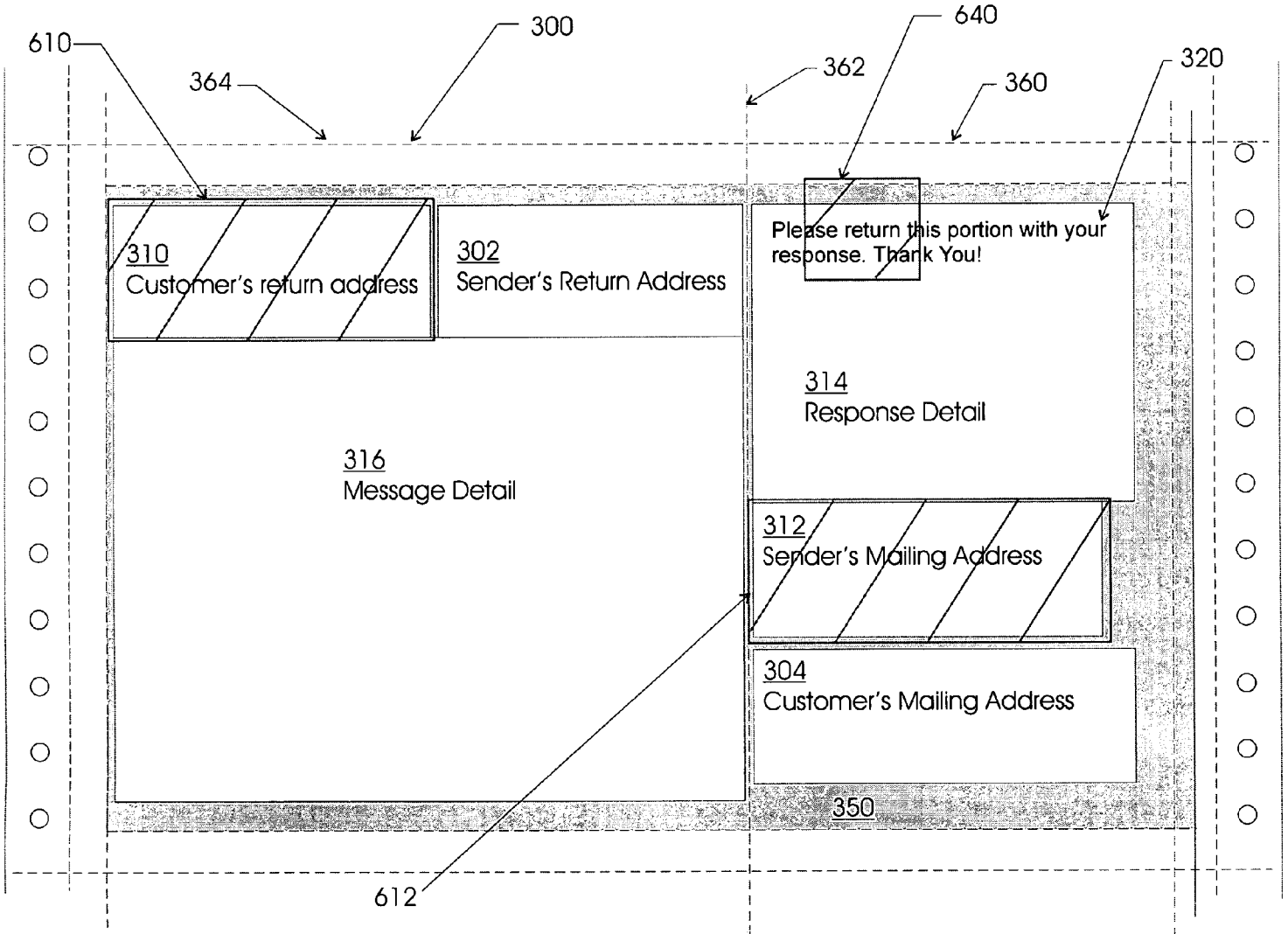
FIG. 5, Part III Face, 300

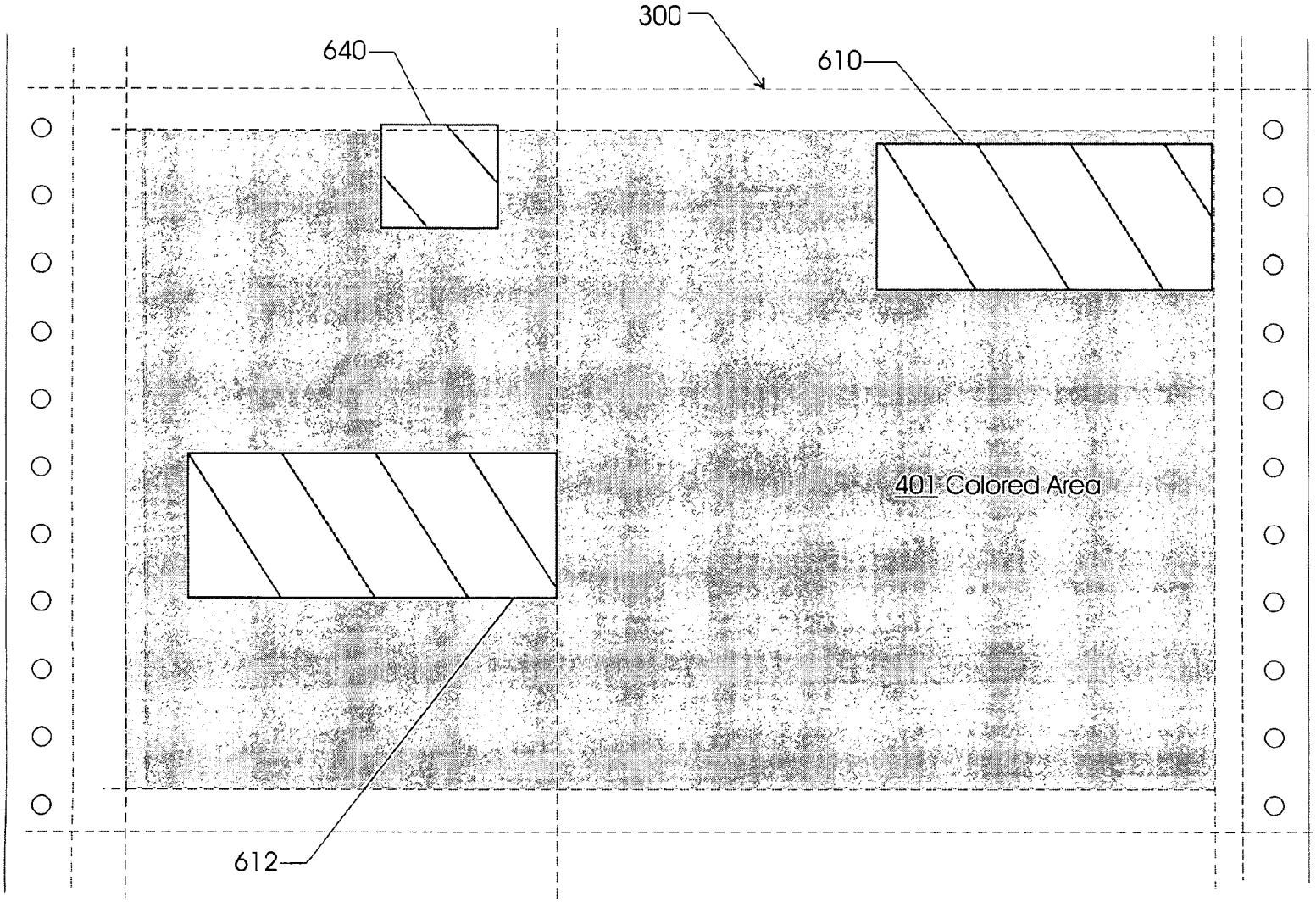
FIG. 6, Part III Back, 300

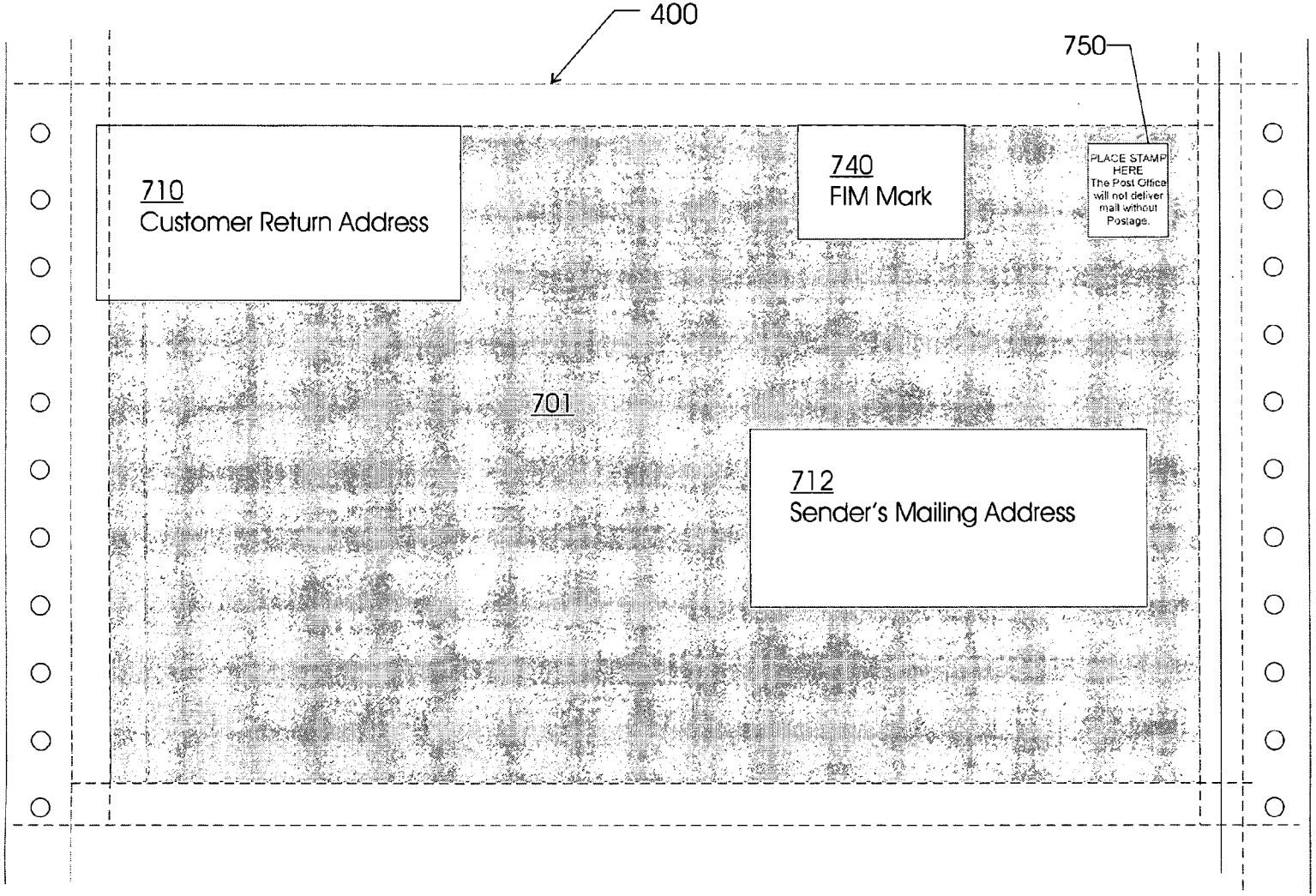
FIG. 7, Part IV Face, 400

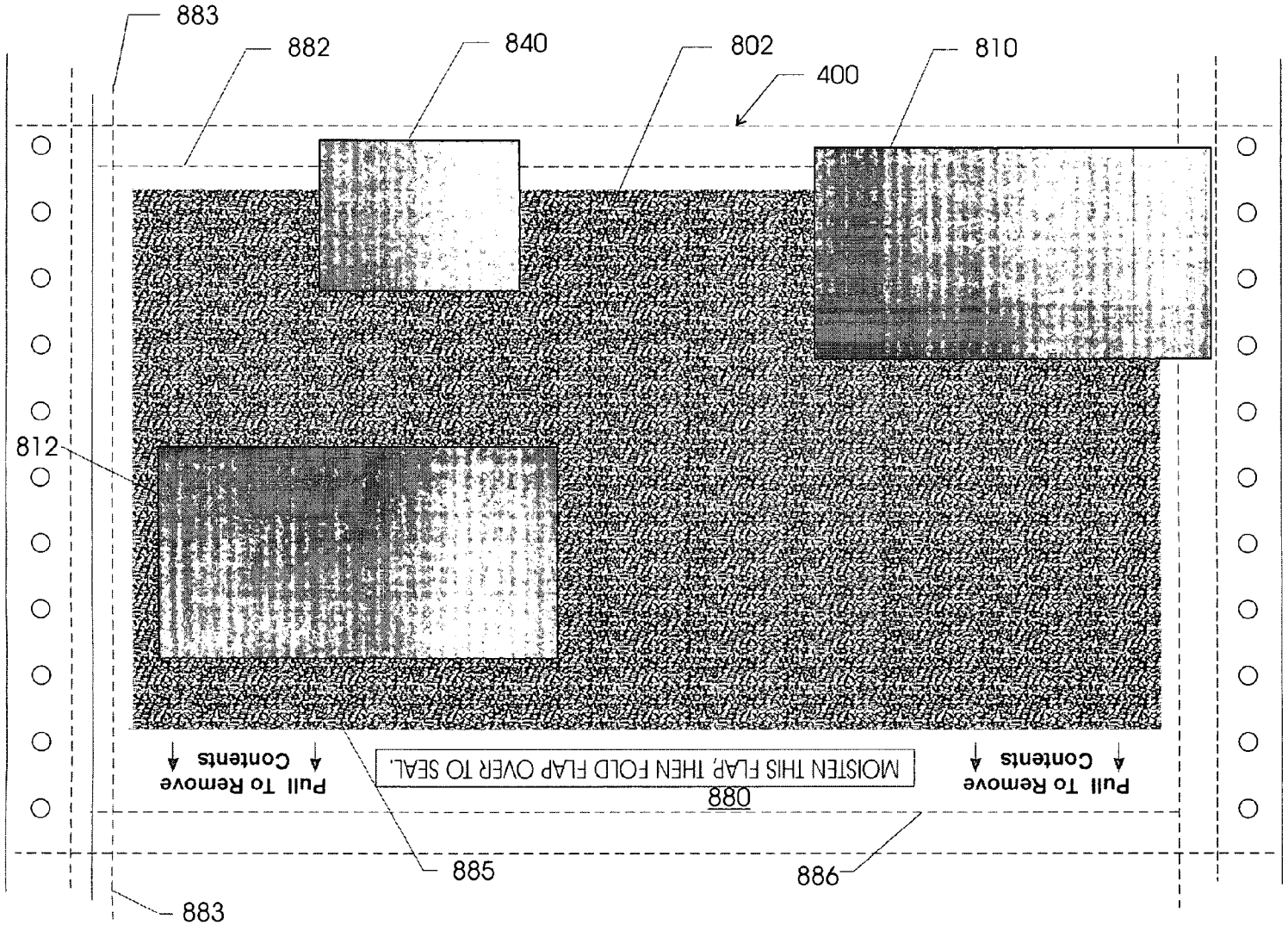
FIG. 8, Part IV Back, 400

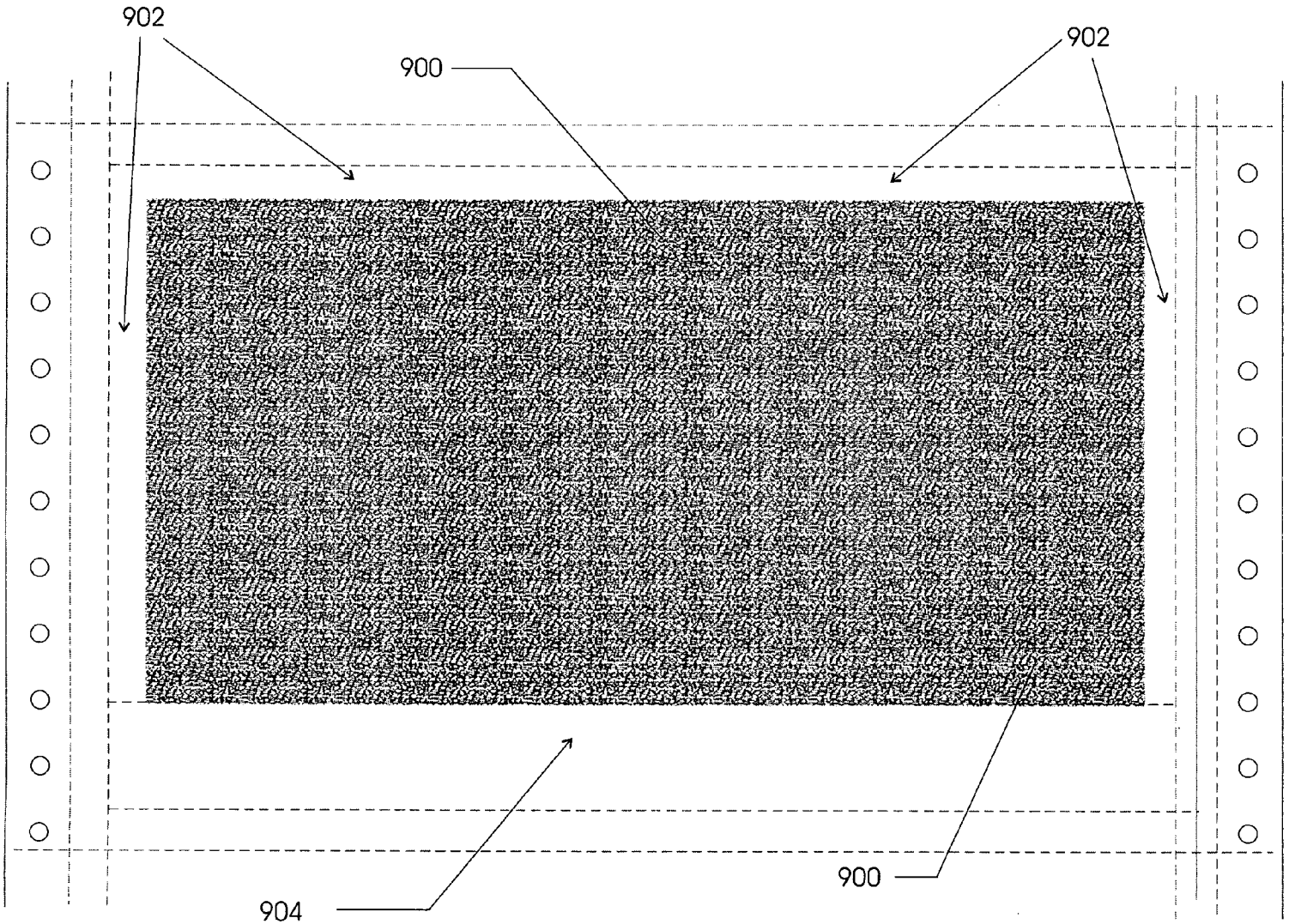
FIG. 9, Part V Face, 500

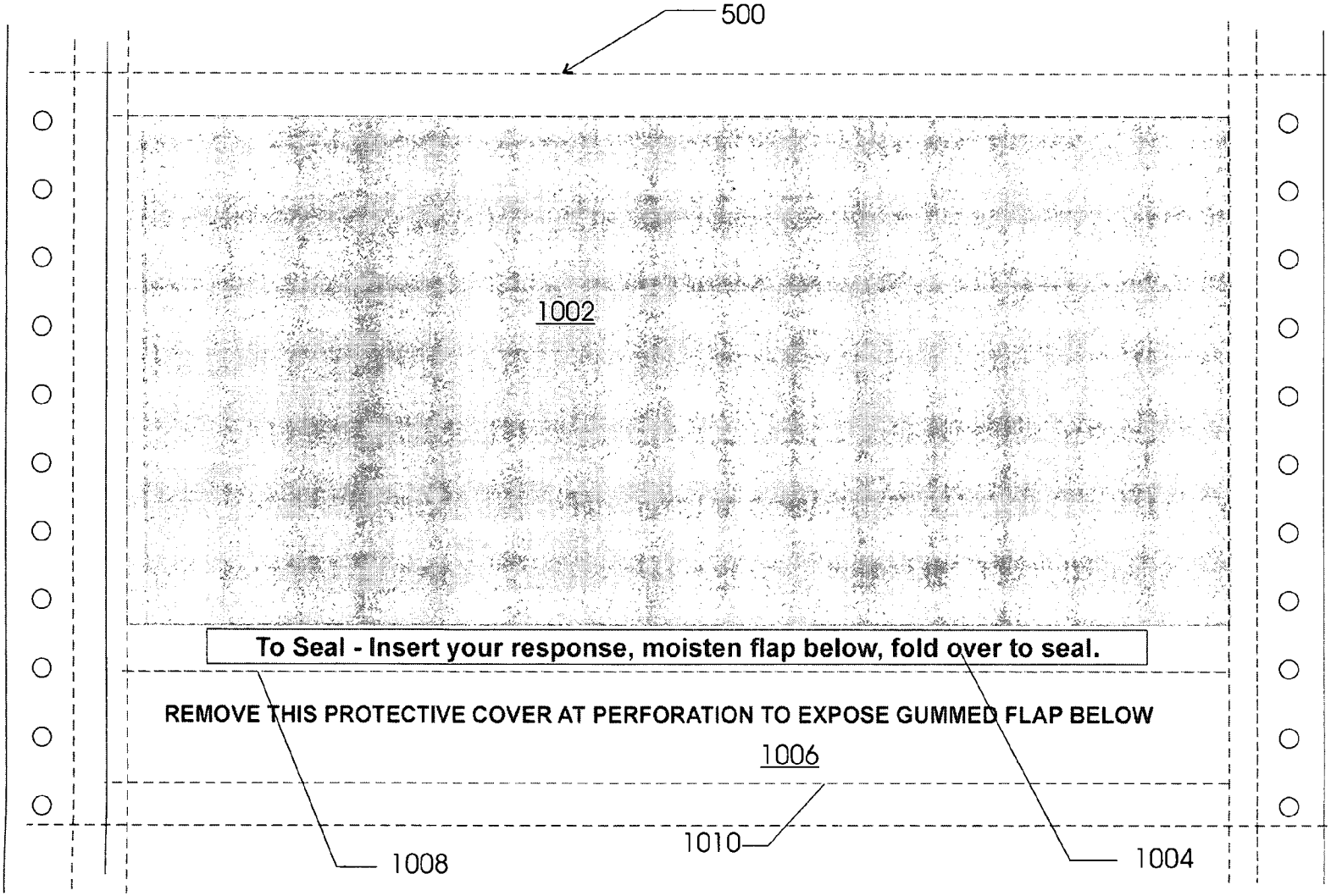
FIG. 10, Part V Back, 500

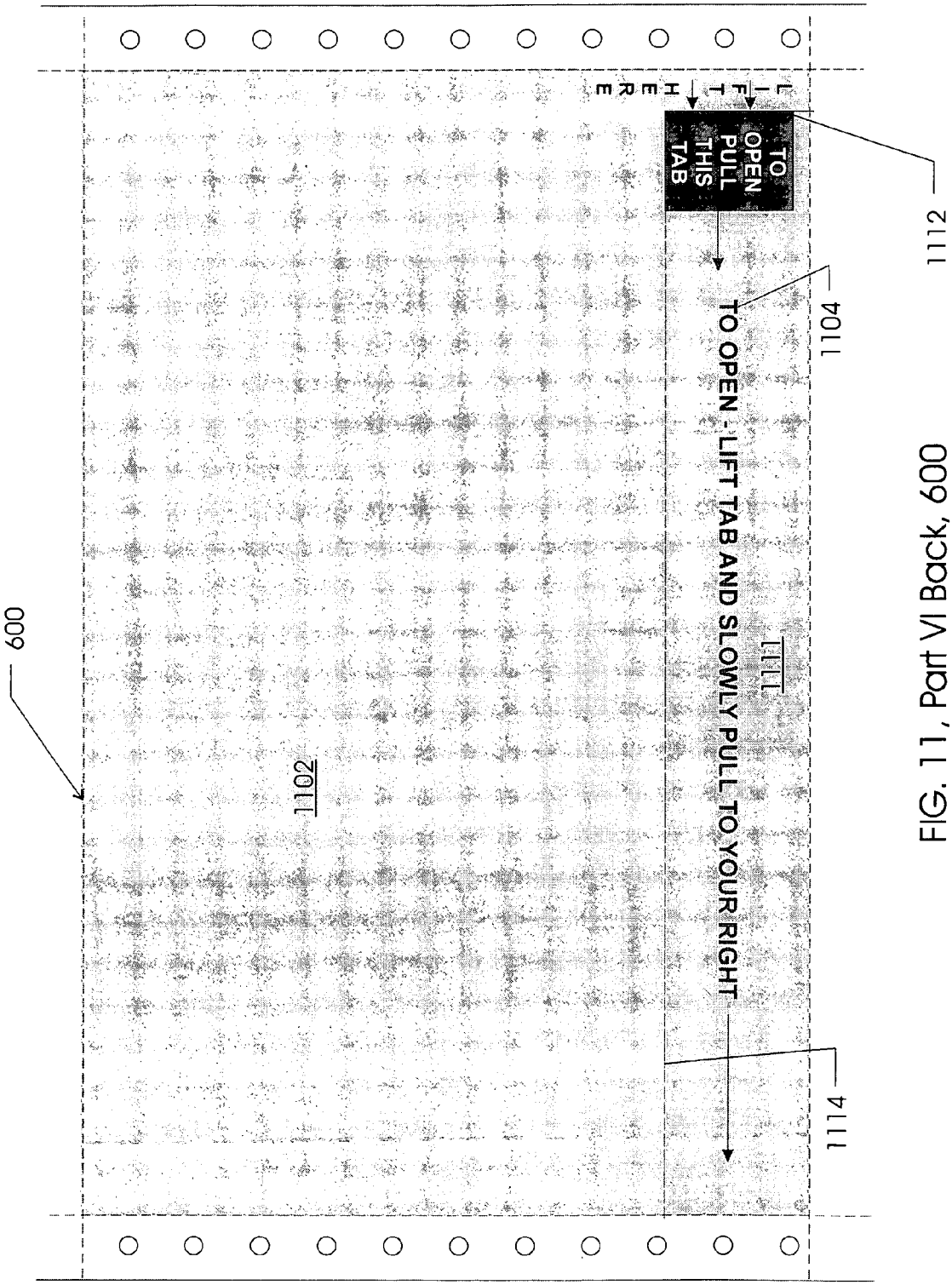
FIG. 11, Part VI Back, 600

POSTAL OUTGOING AND REPLY ENVELOPE FORM SYSTEM

This application claims the benefit of U.S. Provisional application No. 60/120,190 filed Feb. 16, 1999, which is incorporated herein by reference.

BACKGROUND OF THE INVENTION

1. Technical Field

The present invention relates to postal envelopes, and more particularly to a postal envelope form system that has both outgoing and return address information printed by an impact printer on both the outgoing and reply envelopes.

2. Description of Related Art

Although there are many self-mailer form arrangements, there is a need for a postal envelope form system that is versatile, and addresses the needs of the user and customer, the impact printer limitations and postal requirements of today and the foreseeable future.

SUMMARY OF THE INVENTION

A continuous feed, multipart, multilayer form having detachable pin feed edges on each side sized to fit a pin feed impact printer for producing a postal envelope system is disclosed. Each part of the multipart form may have a top sheet, an outgoing envelope, an information sheet and a reply envelope. A series of coatings may be selectively applied to parts of the multipart form so that information impact printed on top sheet produces an addressed and sealable reply envelope, and an information sheet, removably contained within a sealed and addressed outgoing envelope including a postage permit.

BRIEF DESCRIPTION OF THE DRAWINGS

Reference is made to the attached drawings, wherein elements having the same reference numeral designations represent like elements throughout.

FIG. 2 is a block diagram of Part I which forms an originating sheet of the postal envelope form system, and depicts a front face having colored areas and white areas, and shows carbon spots of a back face in cross-hatching.

FIG. 3 is an actual copy of the front face of Part I, and depicts placement of text within the various blocks shown in FIG. 2.

FIG. 4 is a block diagram of a front face of Part II, which forms a portion of an outgoing envelope of the postal envelope form system, and depicts colored and white areas on the front face, and shows carbon spots of a back face in cross-hatching.

FIG. 5 is a block diagram of a front face of Part III, which forms a billing statement of the postal envelope form system, and depicts colored areas and white areas.

FIG. 6 is a block diagram of a back face sheet of Part III of the billing statement shown in FIG. 5, and depicts colored areas, and shows a front view of carbon spots in patterned cross-hatching.

FIG. 7 is a block diagram of a front face of Part IV, which forms a portion of a reply envelope of the postal envelope form system, and depicts colored areas, and white areas which are a mirror image of carbon spots shown in FIG. 6.

FIG. 8 is a block diagram of a back face of Part IV, which forms the same portion of the reply envelope shown in mirror image of FIG. 7, and depicts security screened areas, and shows block-out areas in solid dark blocks.

FIG. 9 is a block diagram of a front face Part V of the back of reply envelope, and depicts a security screened area.

FIG. 10 is a block diagram of a back face of Part V, which is the outside of another portion forming the reply envelope, and depicts colored area and printed directions.

FIG. 11 is a block diagram of a back face of Part VI, which is the outside of another portion of outgoing envelope shown in FIG. 4, and depicts colored areas, directions and a fast pull tab for opening.

DETAILED DESCRIPTION OF THE INVENTION

Figure 1:
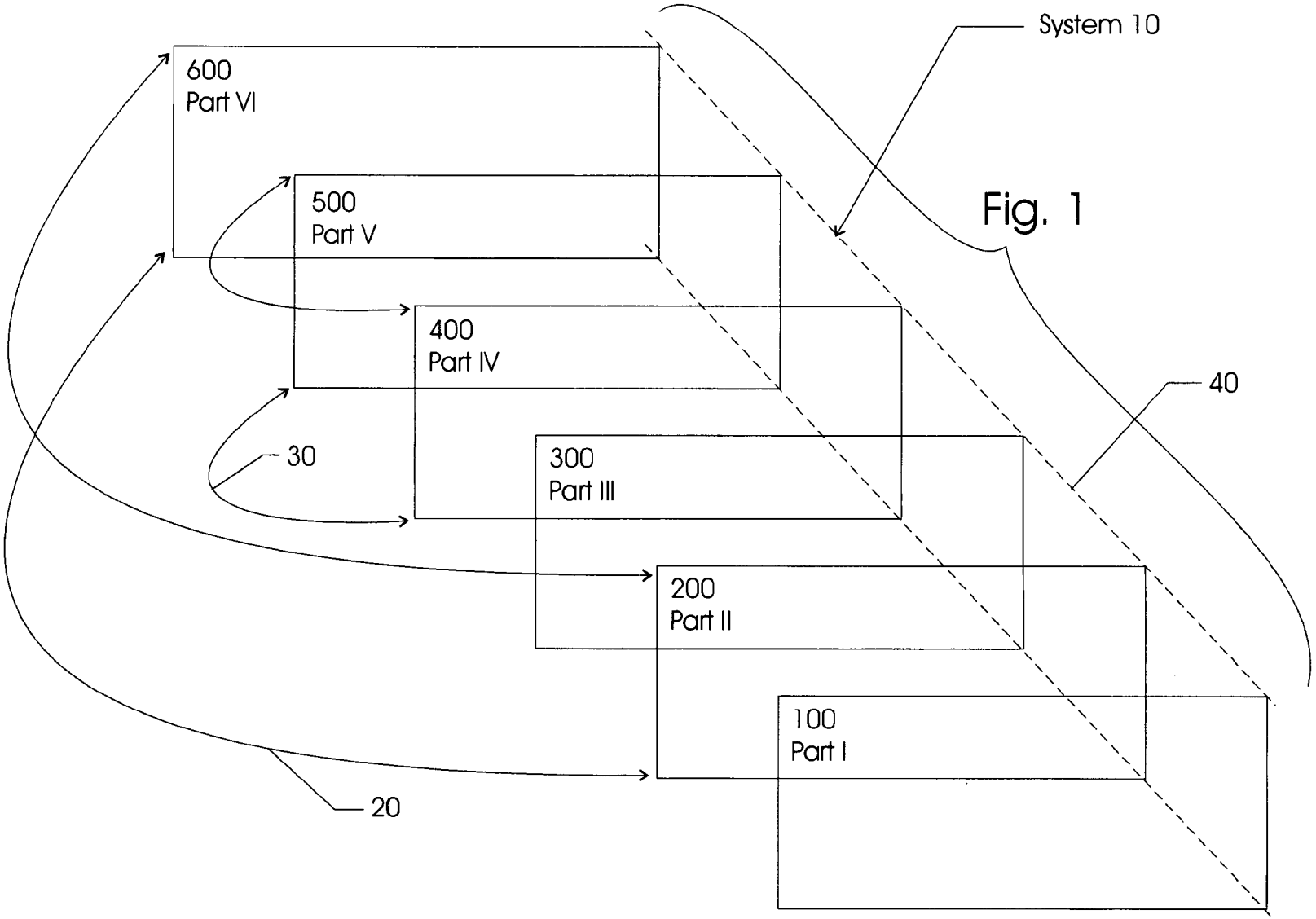
FIG. 1 is a perspective view of a postal envelope form system, and depicts several parts that are attached together to form an embodiment of the present invention.

A postal envelope form system is disclosed that has both outgoing and return address information printed by an impact printer on both the outgoing and reply envelopes in one pass, utilizes white areas and colors to improve scan and delivery accuracy, and positions delivery point barcode outside an area typically smeared by post office processing equipment.

As is well known, the postal service employs automated mail processing systems to facilitate the handling, sorting and delivery of various types of mailers including envelopes. These automated systems employ codes and electronic code reading devices to effect more efficient and accurate mail processing, improve consistency of delivery, lower postal operating costs and increase savings to postal customers.

Numerical mail processing codes corresponding to the address delivery point and now ZIP (Zone Improvement Program) codes are commonly used on envelopes. ZIP coded envelopes without other codes are sent through a postal station where the alpha and numerical ZIP codes are electronically scanned by an optical character reader (OCR) and a processing or sorting code, presently a delivery point barcode in the form of a series or pattern of vertical short and tall bars and which corresponds to the individual numerical code, is applied to each envelope. The bar coded envelopes are passed through a barcode reader (BCR) which electronically reads the barcodes, and a barcode sorter (BCS) to automatically sort the envelopes according to their delivery point barcodes or address destinations.

Reply envelopes that are mailed inside of originating or outgoing envelopes by senders such as businesses and other organizations are now often preprinted (i.e., before mailing) with barcodes. The barcode for reply envelopes for a given organization can be readily printed by the sender when the reply address and any other matter is printed on each of the reply envelopes, since the reply address and barcode are the same for each such reply envelope. By preprinting the barcode on the reply envelopes, the reply envelopes do not have to be passed through the OCR and encoder to be barcode by the postal service, and this can result in cost savings to both the sender and the postal service. Some organizations are preprinting barcodes on outgoing envelopes so that even further savings can be realized under certain circumstances with pre-bar-coded mail.

When the sender preprints the barcode on the reply envelope, another processing or identification code, presently known as a facing identification mark (FIM), can also be preprinted to provide machine detectable codes for the automatic facing and cancellation of reply mail postage, as well as to identify pre-bar-coded reply mail early in the postal processing system. Different FIM marks are presently used for identifying: (1) "business reply mail without barcode, and Penalty Mail or Franked Mail"; (2) "courtesy reply with barcode and affixed stamp"; and (3) "business reply with barcode and Penalty or Franked Mail". There is a unique FIM mark available for each type of business reply mail described above. Such FIM marks are typically in the form of a series of parallel vertical lines printed by the sender in the upper right portion of the mail piece just left of the indicia or stamp position.

The use of outgoing envelopes containing reply envelopes are, however, relatively expensive since two separate and complete envelopes are required, and both envelopes must be printed separately with addresses.

Furthermore, self-mailer forms are typically printed on expensive printers. Inexpensive printers generally could not properly print self-mailer forms. These types of printers include narrow carriage impact printers which are known for a relatively weak printer head punch striking force. This weak striking force causes problems in properly imaging information through to the reply envelope and other parts of an envelope form system.

Additional problems are associated with the current requirements for today's postal standard first class business mail with a business reply envelope. These postal requirements include: (1) complete delivery point postal bar coding on all outgoing envelopes; (2) complete delivery point postal bar coding on the business reply envelopes; (3) a scannable face identification mark (FIM) on the business reply envelope; and (4) a minimum of 70% of the mail delivery point bar coding must be scannable in 1998, 1999's goal is 80%. The Post Office requirements increase in the year 2000, and for years beyond. Specifically, in the year 2000, the scanability of postal bar coding must be at least 90% accurate.

Although there are many self-mailer form arrangements, conventional arrangements do not preprint both mail-to (i.e., outgoing) and return address on both the outgoing and reply envelopes.

Additionally, conventional self-mailers are not entirely imaged all the way to and including the response envelope, while meeting upcoming postal standards required in the year 2000.

Conventional arrangements are not designed for narrow width impact printers while being able to take advantage of all the best postal discounts while imaging complete information on a small format.

An arrangement is needed:

that accommodates for narrow carriage impact printers having a width no greater than approximately ten inches, that is more accurate in reading postal barcodes, that is bar coded and able to be successfully read after being processed through the post office envelope processing system, that reduces damage caused by normal processing as a result of the post office envelope processing system.

There is also a need for a postal envelope form system:

that provides complete information to the user and their customer, that addresses health issues associated with the repetitive task of bursting the envelope form system by hand, that weighs no more than one ounce and is within size dimensions established by post office standards.

There is a need for preventing contents of text preprinted on sheets contained within an envelope from interfering with image contrast or scanning which causes misreading of envelopes and a loss of best postal discounts.

There is a need for preventing misdelivery of mail caused by a large volume of reply mailers all looking the same and being mistakenly delivered to incorrect mailing addresses.

There is also a need for a postal envelope form system that is versatile, and addresses the needs of the user and customer, the impact printer limitations and postal requirements of today and the foreseeable future.

The disclosed postal envelope form system may include an outgoing envelope and a reply envelope contained within the outgoing envelope, wherein the envelopes each have a mail-to address and a return address preprinted thereon.

The outgoing envelope may include a flap enclosure and a tab opening means for easily opening the flap enclosure, wherein the tab opening means is located at a bottom of the outgoing envelope thereby allowing the return address to be located at a top of the outgoing envelope and the customer return address to be located at a top of the reply envelope. This aspect allows the return addresses to be positioned at an uppermost portion of the envelope to free up valuable space which is used for including complete information on each of two portions of a statement.

The outgoing and the reply envelopes may each have delivery point barcodes which identify the intended location for delivering the envelopes, and the reply envelope may include a facing identification mark. These aspects allow the postal envelope form system to qualify for better postal discounts.

The sheets may have a front face and a right side edge, and may be fixed together at the right side edge to strengthen the postal envelope form system at a location where postal processing equipment engages the postal envelope form system during processing.

A top portion of the mail-to address area may be positioned relative to postal equipment that contacts the envelopes to feed the envelopes through a postal envelope processing system such that the delivery point barcode is left substantially un-contacted to thereby reduce smearing of the delivery point barcode.

The postal envelope form system with sheets may include a twelve-and-a-half pound selectively carbonized bond original sheet positioned on top of, a sixteen pound selectively carbonized bond outgoing envelope face sheet positioned on top of, a sixteen pound selectively carbonized bond billing statement sheet positioned on top of, a twenty-four pound register bond reply envelope face sheet positioned on top of, a twenty pound register bond reply envelope back sheet positioned on top of, a twenty pound register bond outgoing envelope back sheet. This unique combination of paper types and weights enables information to be imparted through the several sheets using conventional narrow carriage impact printers which typically do not have a tremendous amount of striking force. This unique combination of paper types and weights combine to make a very strong and durable piece that will withstand the post office equipment punishment.

A method of making a postal envelope form system, may include printing a plurality of sheets, wherein at least some of the plurality of sheets have a selectively carbonized area to enable transfer of information between sheets; attaching the plurality of sheets together so as to form an outgoing envelope, and a reply envelope contained within the outgoing envelope, and wherein each of the outgoing and reply envelopes are able to have mail-to and return addresses preprinted thereon using the selectively carbonized area. These aspects allow forms to be created which will have complete information provided on various portions of the postal envelope form system using a conventional narrow carriage impact printer.

A method of using a postal envelope form system may include printing information on the postal envelope form system, the information including billing information; mailing an outgoing envelope having pre-preprinted first mail-to and return addresses, the outgoing envelope having contained therein a reply envelope having preprinted second mail-to and return addresses. Having preprinted reply envelope mail-to, delivery point barcode and return addresses along with a FIM mark allows for postal discounts to be qualified for.

A further aspect may provide preprinting textual information intended for being scanned by post office processing equipment in white areas located among colored areas to facilitate accurate delivery. This increases the accuracy in delivery since the high contrasting white areas contain the text required for scanning. This also allows color coding to distinguish between similar self-mailers from being misdelivered to an incorrect address based on appearance. White areas on the outgoing and reply envelopes may be 2/10 wider and taller than the matching text area shown on Part I to increase tolerance in collating the several sheets, and thereby ensure information to be scanned is located within high contrast areas.

A method using a postal envelope form system may include receiving a first envelope having preprinted first mail-to and return addresses, the first envelope having contained therein a second envelope for reply having preprinted second mail-to and return addresses, and providing at least one of payment and payment information, and mailing the reply envelope along with at least one of payment and payment information. These aspects allow users of the invention to readily return payment in compliance with postal requirements. A similar advantage may be realized by receiving at least one of a good and service; and receiving a first envelope having preprinted first mail-to and return addresses, the first envelope having contained therein a billing statement associated with at least one of a good and service, and a second envelope for reply having preprinted second mail-to and return addresses.

The outgoing envelope may include a flap enclosure and a tab opening means for easily opening the flap enclosure, wherein the tab opening means is located at a bottom of the outgoing envelope thereby allowing the biller return address to be located at a top of the outgoing envelope and the customer return address to be located at a top of the reply envelope.

A method of making a postal envelope form system may include printing a plurality of sheets, some of which have selectively carbonized areas used for transferring information impact printed thereon to a sheet underneath; forming lines of weakness in the plurality of sheets to allow easy separation of a billing statement from a reply envelope, both contained within an outgoing envelope; and gluing the plurality of sheets together to form the postal envelope form system. These aspects allow for both easy separation of form portions, while providing a reinforced edge that typically receives damaging treatment from postal processing equipment.

A line of weakness transverse to a height of the postal envelope form system may be provided thus creating a series of connected, but weakened, individual postal envelope form systems. This aspect allows for fast automated printing of a plurality of forms sequentially.

FIG. 1 is a perspective view of a postal envelope form system 10. System 10 includes several sheets or parts that are attached together. System 10 is intended to be used as a self-mailer billing system where an outgoing envelope is mailed to a customer along with billing information and a reply envelope is to be used to return payment or payment information in exchange for goods or services rendered.

The several sheets shown in FIG. 1 include a Part I 100 which is attached to a Part II 200, which is attached to a Part III 300, which is attached to apart IV 400, which is attached to a Part V 500, which is in turn attached to a Part VI 600. Part I 100, Part II 200, Part III 300, Part IV 400, Part V 500, and Part VI 600 are attached on right side edge 40 in order to strengthen portions of system 10 that undergo postal processing by processing equipment used in delivery of mail.

Part I 100 may be formed from a sheet of twelve-and-a-half pound selectively carbonized bond paper. The twelve-and-a-half pound designation is commonly understood in the paper and forms-processing industry as corresponding to the weight of 1000 sheets of a specific size of paper. The selective carbonization is dependent on the location of information printed on Part I 100 which is intended to be imparted onto other parts attached underneath. This will be described more fully below.

Part II 200 may be formed from a sheet of sixteen pound selectively carbonized bond paper. Part III 300 may be formed from a sheet of sixteen pound selectively carbonized bond paper. Part IV 400 may be formed from a sheet of twenty-four pound register bond paper, which is similar to carbonized bond with one exception that carbon is not attachable to the register bond paper as readily as with the carbonized bond paper. Part V 500 may be formed from a sheet of twenty pound register bond paper, and Part VI 600 may be formed from a sheet of twenty pound register bond paper.

Part II 200 and Part VI 600 may be attached together to form an outgoing envelope 20 which is readily separable from the other attached parts of system 10 as will be described in detail below. Outgoing envelope 20 may enclose Part III 300, Part IV 400, and Part V 500.

Part IV 400 and Part V 500 may be attached together to form a reply envelope 30 which is readily separable from the other attached parts of system 10 as will be described in detail below. Part IV 400, being made off thicker and heavier paper, provides significant strength to both the reply envelope 30 and outgoing envelope 20 which assists in preserving postal envelope form system 10 upon encountering processing machinery. Additionally, attaching Parts I–VI by gluing right side edge bolsters the durability of postal envelope form system 10 which typically progress through postal processing machinery with the right edge leading the remainder of the Parts.

FIG. 2 is a block diagram of Part I 100 which may form an originating sheet of the postal envelope form system. Part I 100 is the originating sheet upon which a printer prints information. The postal envelope form system 10 was designed for use with a relatively inexpensive impact printer (not shown) having a narrow carriage (e.g., Okidata Microline 320 Turbo). These types of printers are common in the industry due to their low cost and reliability.

The information printed by such printers may include billing information identifying the goods or services rendered, the time period covered, mailing information, and postage information, which are discussed further below. Part I and originating sheet will be used interchangeably hereinafter with reference to numeral 100.

FIG. 2 depicts originating sheet 100 as having a colored area 101 among various and white areas that will be discussed individually. Reference is made to originating sheet 100 in conjunction with other parts throughout the remaining discussion.

Specifically, originating sheet 100 may include a sender return address area 102 within which a sender return address is printed before mailing (i.e., preprinted). FIG. 2 also shows in cross-hatching a carbon spot 102*a* located on a back face (not shown) of originating sheet 100. Carbon spot 102*a* enables the force of the impact printer used to impart information onto the sheet immediately below originating sheet 100, which is Part II 200.

Therefore, originating sheet (Part I) 100 is printed with the information that is intended to be printed on sheets beneath it. Thus, originating sheet (Part I) may be preprinted with all the information printed on system 10. Originating sheet 100 also may include customer mailing address area 104 within which a customer mail-to address is printed before mailing along with a delivery point barcode discussed further in conjunction with FIG. 3 below. FIG. 2 also depicts in cross-hatching a carbon spot 104*a* that may be located on a back face (not shown) of originating sheet 100. Carbon spot 104*a* enables the force of the impact printer used to impart information onto Part II 200, which is the face of outgoing envelope 20.

Originating sheet 100 may also include a postage permit area 106 within which postage permit information is printed before mailing. The postage permit information is that which the post office uses in assigning a postage charge and postage discounts to the sender.

FIG. 2 also depicts in cross-hatching a carbon spot 106*a* that may be located on a back face (not shown) of originating sheet 100. Carbon spot 106*a* enables the force of the impact printer used to impart information onto Part II 200, which is the face of outgoing envelope 20.

Originating sheet 100 may be approximately five-and-a-half inches tall and nine- and five-eighths inches wide, which fits within narrow carriage impact printers that are typically approximately ten inches wide. Generally, forms similar to postal envelope form system 10 are approximately nine-and-a-half inches wide. However, system 10 may be made an eighth of an inch wider to accommodate areas large enough to include reasonable amounts of information, yet still fit within size dimension standards of the post office. The half inch tolerance typically provided was necessary for other forms, but the form of system 10 is able to reduce this by ⅛th of an inch. This allowed the width of system 10 to be increased to 9 ⅝th of an inch.

Since originating sheet 100 may include all the information printed on the various other parts of system 10, originating sheet 100 is useful for keeping records of the sender. Furthermore, originating sheet 100 may incorporate a line of weakness or perforation 107 transverse to the width that allows a portion 107*a* to be separated from a portion 107*b*. Portion 107*a* can be used as a reminder billing statement, while portion 107*b* can still be retained for record keeping purposes. Thus, originating sheet 100 can be used as a reminder bill or a collection bill, with both a customer receipt and a remittance copy.

FIG. 3 is a copy of the front face of originating sheet (Part I) 100, and depicts placement of text within the various blocks shown in FIG. 2. Specifically, sender return address area 102, customer mailing address area 104, and postage permit area 106 are shown with text contained therein. Sender return address area 102 has a return address shown, but with the name of the sender removed for confidentiality purposes. The name of the sender may be printed uppermost in sender return address area 102. Similarly, customer mailing address area 104 and postage permit area 106, may have information printed uppermost in the areas 104 and 106. In the case of customer mailing address area 104, the uppermost information may be delivery point bar coding 108 that allows certain postage discounts to be credited to the mailer of outgoing envelope 20 upon which the bar coding 108 is transferred. A series of circular cuts 109 are located on each side of system 10, in parallel, to form pin-feed margins that assist printers in feeding forms through a printing path during printing.

FIG. 4 is a block diagram of a front face of Part II, which forms a portion of an outgoing envelope 20 upon which the information in the sender return address area 102, the customer return address area 104, and postage permit address area 106 are imparted by the impact printer. FIG. 4 depicts a colored area 202 within which white areas 102', 104', and 106' are located. White areas 102', 104', and 106' correspond to the sender return address area 102, the customer return address area 104, and postage permit address area 106 of originating sheet (Part I) 100. Note boxes 102', 106' and 104' on FIG. 4 may be much larger than their corresponding twin images on FIG. 3. This may be necessary to insure scanability.

The colored areas 202 provide a visual indication that allows outgoing envelopes sent by the same sender to be easily identified with the sender. The colored areas of all parts of system 10 can be kept the same, or varied if desired, to create meaning associated with the colors. For example, all the colored areas of system 10 can be kept the same color to associate various parts being mailed at different times in reply with a particular mass outgoing mailing. Alternatively, various parts can be differently colored to provide an visual indication of which part among system 10 is being seen without having to refer to the contents of the part.

The white areas are purposefully not colored to enable the information printed within to be easily read by users and scanning equipment associated with postal envelope form system 10. The information within the white areas is transferred from Part I 100 to Part II 200 is achieved through the selectively positioned carbon spots 102*a*, 104*a*, and 106*a* located on the back face of Part I 100.

FIG. 4 also depicts carbon areas 204, 206 and 208 which transfer information imparted by the impact printer onto originating sheet (Part I) 100 and through to a billing statement sheet (Part III) 300 (FIG. 5). The information imparted by the impact printer onto originating sheet (Part I) 100 and that is transferred to billing statement sheet (Part III) 300, may include information contained within the sender return address area 102 and within the customer mailing address area 104. The information additionally may include a customer return address area 110, a distributor or sender mailing address area 112, a response detail area 114, and a message area 116.

The information contained within customer return address area 110 may be transferred by carbon spot 204 to billing statement (Part III) 300 within a customer return address area 310 shown in FIG. 5. FIG. 5 is a block diagram of a front face of Part III, which forms a billing statement of the postal envelope form system and depicts colored areas 350 among which white areas such as customer return address area 310 are located. Other white areas located among colored areas 350 may include a sender return address area 302, a customer mailing address area 304, a sender mailing address area 312, a response detail area 314, and a message area 316. The same information imparted to originating sheet (Part I) may be imparted to billing statement (Part III) 300, with the exception of the postage permit 106 and a face identification mark (FIM) discussed below. Thus, billing statement (Part III) 300 contains complete information.

FIG. 5 may additionally include directions 320 that in the embodiment shown instruct the recipient of billing statement (Part III) 300 to "Please return this portion with your response. Thank You!". The portion requested for return is a remittance copy 360, which is separated by a line of weakness (perforation line) 362 from a customer copy 364. Thus, a customer can retain customer copy 364 as a courtesy when the customer returns the remittance copy 360 with payment or payment information in reply to receiving billing statement (Part III) 300.

FIG. 6 is a block diagram of the back face of billing statement (Part III) 300 shown in FIG. 5. FIG. 6 depicts a front view of this back face billing statement (Part III) 300, and shows carbon spots in patterned cross-hatching among a colored area 401, The carbon spots in FIG. 6 may be selectively positioned to correspond to the location of information imparted by the impact printer on originating sheet (Part I) 100 and to be transferred to similarly positioned areas on reply envelope 30 shown in FIG. 7.

Originating sheet (Part I) 100 may further include a face identification mark (FIM) area 140 that corresponds to a carbon spot 640 in FIG. 6. It should be noted that FIG. 6 is a back view of billing statement (Part III) 300, and is therefore a mirror image of the positioning of FIM area 140. Similarly, FIG. 6 includes a distributor mailing address area 612 which is a mirror image of the positioning of distributor mailing address area 112 shown in originating sheet (Part I) 10 (FIGS. 2 and 3). The distributor mailing address area 612 is a carbon spot that imparts the address information of the sender of the outgoing envelope shown in FIG. 7. FIG. 6 also includes a carbon spot 610 that corresponds in mirror image to customer return address area 110 shown in FIGS. 2 and 3.

FIG. 7 is a block diagram of a front face of Part IV, which forms a portion (the front sheet) of reply envelope 30 of the postal envelope form system of the present invention. FIG. 7 depicts colored area 701, and white areas which are a mirror image of carbon spots shown in FIG. 6. Specifically, FIG. 7 shows a customer return address area 710, a distributor mailing address area 712, and a FIM mark 740 as white areas. Note boxes 710, 712 and 740 on FIG. 7 may be much larger than their twin image on FIG. 3. This may be necessary to ensure scanability. The white area provides high contrast with the information contained therein which was imparted by the carbon spots 610, 612, and 640 shown in FIG. 6. FIG. 7 is a front view of reply envelope 30 and therefore the positions of areas 710, 712, and 740 match with the positions of areas 110, 112, and 140 shown in FIG. 2; whereas the areas 610, 612, and 640 of FIG. 6 are mirror imaged in comparison because FIG. 6 is a back view.

FIG. 7 also includes direction area 750 which in this embodiment instruct the user of reply envelope 30 to "PLACE STAMP HERE The Post Office will not deliver mail without Postage." The postage placed at or near direction area 750 is cancelled by post office processing equipment. The inclusion of FIM 740 and a delivery point barcode in address area 712 on reply envelope 30 may allow the user of postal envelope form system 10 to qualify for additional postage discounts credited upon payment for mailing outgoing envelope 20, as long as other criteria are met. The other criteria may include a threshold readability or accuracy level above which a percentage of the mailings sent by users must surpass. In the year 2000, 90% postal bar coding contained in mail-to address areas such as address area 712 must be scannable by postal processing equipment. If the 90% threshold is not meet, the discounts on postage are not given. These discounts can be approximately six cents per envelope which is quite significant when using business mailers to solicit payment for goods or services rendered from a very large number of customers.

FIG. 8 is a block diagram of a back face of Part IV, which forms the same portion of the reply envelope shown in mirror image of FIG. 7. FIG. 8 depicts security screened areas 802, and shows block-out areas in solid dark blocks 810, 812 and 840 which correspond to areas 710, 712 and 740 in FIG. 7. The security screened area 802 may prevent information contained within reply envelope 30 from being either read or scanned through the paper of envelope 30. Dark blocks 810, 812 and 840 may enhance the scanability of the reply envelope address data in white block's 710, 740 and 712. Blocks 810, 812 and 840 may prevent any image of envelope contents or security pattern from showing through the front of the reply envelope. This prevents information contained in the reply envelope under the areas of 710, 712 and 740 from being mistakenly scanned by postal processing equipment attempting to scan reply envelope 30. It has been found that errors in scanning were reducing the accuracy rate required to qualify for the best postage discounts.

FIG. 8 also depicts a flap 880, formed by line of weakness 885 and edge 886, upon which moistenable glue is placed. Flap 880 can contain parallel lines of glue to better ensure that envelope 30 seals properly. Flap 880 may also serve as a direction area. The directions in this embodiment instruct the user to "MOISTEN THIS FLAP, THEN FOLD FLAP OVER TO SEAL". Flap 880 folds about line 885 and attaches to the other portion of envelope 30 formed by Part V 500. The directions in this embodiment also instruct the user to "Pull To Remove Contents". The removal instruction is for separating the reply envelope 30 (Parts IV and V) and billing statement 300 (Part III) from outgoing envelope 20. The separation is achieved in part due to lines of weakness formed before the various Parts I–VI are attached together. Specifically, line of weakness 883 is a perforation that allows easy separation by simply pulling reply envelope 30 (Parts IV and V) and billing statement 300 (Part III) from outgoing envelope 20. Line of weakness 883 once completely weakened form the boundary of reply envelope 30 along with an edge 886.

The return envelope of FIG. 8 is bounded at its top by edge 882 and on its bottom by edge 886. The right edge 883 connects the top edge 882 and the bottom edge 886. The left end of the return envelope is formed by the line of weakness 881.

FIG. 9 is a block diagram of a front face Part V of the back of reply envelope 30. FIG. 9 depicts a security screened area 900 that prevents sensitive information contained within reply envelope 30 from being easily read through the sometimes transparent sheets of paper forming the various Parts of postal envelope form system 10. An edge 902 is attached, such as by glue, to a correspond edge on the back of Part IV 400 shown in FIG. 8. An edge 904 is left unattached so that an opening is formed in reply envelope 30.

FIG. 10 is a block diagram of a back face of Part V, which is the outside of the other portion forming reply envelope 30. FIG. 10 depicts colored area 1002 and printed direction area 1004. A flap 1006 formed by a line of weakness 1008 and an edge 1010 may be glued to a front face of Part VI 600 so that when a tab of Part VI 600 is removed, flap 1006 is removed along with it. In the event that flap 1006 is not removed as intended, instructions reading "REMOVE THIS PROTECTIVE COVER AT PERFORATION TO EXPOSE GUMMED FLAP BELOW" clearly tell the user what to do. The gummed flap referred to is that flap 880 mentioned above in conjunction with FIG. 8.

FIG. 10 shows the back face of part 4, and has a protective flap 1006 defined by a line of weakness 1008 and the lower edge 1010. This flap 1006 should preferably be removed before the envelope is sealed.

FIG. 11 is a block diagram of a back face of Part VI, which is the outside of the other portion of outgoing envelope 20 shown in FIG. 4. FIG. 11 depicts a colored area 1102, a direction area 1104 and a fast pull flap for opening the outgoing envelope 20. Direction area 1104 instruct the recipient of outgoing envelope 20 how to operate fast pull tab 1111: "TO OPEN—LIFT TAB AND SLOWLY PULL TO YOUR RIGHT". Tab 1111 includes an unattached portion 1112 which can be lifted easily to grasp and pull tab 1111 at a line of weakness 1114. Although the instructions indicate that the user is to pull to their right, the tab is located on the bottom (and printed upside down) relative to the orientation of the writing on the front faces of outgoing envelope 20 and reply envelope 30.

This location and orientation of tab 1111 may be significant in many respects. The location of tab 1111 on the bottom and back of outgoing envelope 30 (as oriented by the writing on envelopes 20 and 30) allows the return address areas of envelopes 20 and 30 to be positioned at the uppermost edge since there is no interference with a conventionally placed folding closure flap. In other words, in conventional envelopes, the closure flap is placed at the top which would force the return address to be positioned only as high as the folding line. The position, location and orientation of tab 1111 does not force the return address of the outgoing envelope to be lowered. This allows a greater amount of information to be imaged on the various parts of postal envelope form system 10.

Furthermore, tab 1111 may constructed with unattached portion 1112 and perforation 1114 to reduce damage to the contents of outgoing envelope 20 such as ripping or tearing the billing statement (Part III) 300 or reply envelope 30. Similarly, reply envelope 30 has flap 880 located at the bottom which allows the return address area 710 (FIG. 7) to be positioned uppermost (within certain tolerances) on reply envelope 30. This allows a greater area for message areas 116 (FIGS. 2 and 3), message area 316 (FIG. 5), and response detail areas 114 and 314.

Having fully described a preferred embodiment of postal envelope form system 10 above, a few additional points should be made to elaborate on how the preferred embodiment shown in system 10 may provide certain advantages and meet various needs identified in the industry. First, narrow carriage impact printers have limitations that the design had to overcome, one being the maximum width of the form being ten inches. Second, the striking force of impact printer's print head limits the number and weight paper being used. Third, the print speed of narrow carriage printers is slow compared to other options.

In this embodiment, the form may be kept as small as possible to limit wasted motion of the print head, to fit within narrow carriage impact printers, to fit size dimension standards of the post office, and to weigh approximately less than one ounce. Managing the strike force of the impact printer head may be achieved by the combination of paper weights and other characteristics.

In this embodiment, system 10 may provide complete return address and mail-to address information on both the outgoing and the business reply envelopes 20 and 30. The billing statement (Part III) 300 may have a vertical perforation that separates the sheet into remittance copy 360 and customer copy 364, both of which may have complete information due to the careful positioning of areas throughout the various parts. The information on both portions may include: (1) name and address of sender; (2) name and address of customer; (3) detailed information on the customer copy; (4) response information on the billing statement; (5) account numbers on both portions; (6) postal bar coding on each envelope; and (7) the FIM mark on the reply envelope.

System 10 is very flexible in that it allows postage indicia to be printed thereon, or a stamp or metered postage to be used. FIM marks are not required on all mail, and system 10 allows FIM mark to be imaged or not imaged. When used, FIM marks have been tested in postal processing equipment and achieved a 99.9% readability rate. System 10 also allows postal bar coding to be printed when desired.

Furthermore, postal endorsements are required periodically and several options are available to post office customers. These endorsements come with various costs charges by the post office and each one has differing verbiage. The post office requires use of such endorsements once every six months, however, postal customers using system 10 can use the endorsements monthly if they choose. Complete freedom of which endorsement is used, how frequently it is used, or use of a different endorsement on each mailing is possible using system 10. Additional flexibility is provided by choosing which color system 10 will be.

Contrast is an important element of being able to read the address and postal bar coding on the envelopes by the post office scanning equipment. System 10 takes advantage of this by focusing the scanner's attention to the vital data area. These areas are the mail-to address, return address, the FIM mark, and postage permit area. These areas may be white with contrasting dark printing, or other highly contrasting combinations of colored area and colored information therein. The boxes that form these focal areas may allow 1/10th of an inch free space around the data image area. The post office standards require 1/25th of an inch free space around all scannable data. In originating sheet 100 the colored portions are located between addresses 102 and 110, between areas 114 and 116, and between postage permit 106 and area 114. The balance of the surface may be printed in an ink color which causes reduced contrast. The post office scanners find the data in the high contrast areas.

Locating the postal bar coding in the mail-to address areas in envelopes 20 and 30 may also be very important. In a preferred embodiment, the barcode be the first line printed, and is located at the very top of the address box as seen in FIG. 3 in areas 104 and 112. This moves the barcode up and out of the way of the post office handling equipment that is most viscous to the area which otherwise smudges the barcode. The positioning shown in FIG. 3 improved readability of the barcode from 60% to 98% after six passes through the postal equipment. The business reply envelope address may be located above the outgoing address area which protects the barcode therein from similar damage. The reading results of the business reply envelope is 95% after going through the postal equipment 12 times.

Another important feature of system 10 may be the block-out patterns which are printed on the inside of the envelopes. This prevents data or information contained within the envelope from being scanned and interfering with barcodes or address lines. The fine screened box of system 10 appears to be solid to scanners, so there is no mistaking a pattern as information.

The positioning of tab 1111 on the bottom backside of the envelope may also very important to the success of system 10. First, locating tab 1111 on the bottom of the envelope 30 permits variable information to be imaged to the very top of the form. This allows the complete form design to be moved up to the very top of the envelope. The top may be the ideal position for the return address information for the outgoing and reply envelopes 20 and 30, FIM 740, and postal indicia 106. This change allows the postal barcode to be moved up out of the way of the post office equipment in order to limit damage and smearing to improve readability.

Orientation of tab 1111 may also be very important to control of damage resulting from post office processing equipment. Tab 1111 is best located behind the left side of the face of the envelope 20; in other words, on the right side facing the back of envelope 20. This orientation prevents the tab 1111 from accidentally being snagged and opened while traveling through the postal equipment.

Crumple damage control of the right vertical edge of system 10 may also be important. Post office equipment has a catch or bar stop that blocks the envelope path when the envelope hits the stop. The impact of envelopes 20 and/or 30 against the catch can cause crumple damage to the mail piece. This damage can lead to the ordinary mailers being further damaged or destroyed by postal handling equipment. System 10 may reinforce the right edge 40 to minimize crumple damage.

Lastly, the paper weights and characteristics have been selected very carefully to yield durability and strength, while allowing imaging through all parts. Other paper weight combinations can be used, as various other combinations have been tested. However, the combination of types and characteristics provided herein represent the best mode known to date.

System 10 provides readability by postal scanners of barcode on both outgoing and reply envelopes higher than the requirement established by the year 2000 goal of 90% accuracy. Block out blocks, such as solid blocks 840, 810 and 812, can also be applied to standard envelopes (e.g., only a single envelope not necessarily contained in a system) to improve postal scanning of alpha numeric address information. System 10 provides an ergonomic design of forms, which reduces injury to users hands and arms from repetitive manual bursting. This is accomplished this by weakening the pin feed and between form perforations by using perforation that have wider cuts and narrower ties between perforations. This weak perforation requirement for the purpose of protecting the health of the user and the employees has never been accomplished before.

System 10 is extremely flexible and user friendly. For instance, customers can change addresses without concern of form cost.

System 10 establishes focal points on both outgoing and reply envelopes in the form of white boxes which contain the variable data in the form of to and from addresses, delivery point barcodes and FIM mark. These focal points helps the postal equipment to find, read and sort with a very high degree of accuracy approaching 100%. Managing printer impact on system 10 to achieve a scan accuracy of almost 100% may require careful selection of paper weights.

While this system has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims. For example, fewer than six parts could be used while still imparting substantially the same information on the number of parts actually used. Additionally, another embodiment could replace the originating sheet with an electronically stored version of the information contained on the originating sheet, thereby allowing fewer than six parts to be used. Furthermore, it is envisioned that other paper types and weights combinations could be readily used to achieve transfer of information through the number of parts used in an embodiment. Alternatively, when greater than six parts are used, adjustment of part weights and types may be necessary to image through the parts, depending on printer strike force. Similarly, improvements in either impact printers and/or postal processing equipment in use may bring about other embodiments, as long as the printer used is able to legibly impart the information that is readable/scannable by the postal processing equipment.

What is claimed is:

1. A postal envelope system, comprising:

a continuous feed, multipart, multilayer form;

detachable pin feed edges on each side of the form, the form sized to fit a pin feed impact printer;

A) each part of the multipart form including, in the following order:

I) a top sheet detachable from both pin feed edges;

II) an outgoing envelope front sheet detachable from both pin feeds edges;

III) a message sheet detachable from one pin feed edge and not attached to the other pin feed edge;

IV) a reply envelope front sheet not attached to either pin feed edge, the reply envelope front sheet including a bottom flap;

V) a reply envelope back sheet not attached to either pin feed edge and fastened on three sides to the reply envelope front sheet to form a reply envelope closable by folding the bottom flap; and VI) an outgoing envelope back sheet detachable from both pin feed edges and fasted on four sides to the outgoing envelope front sheet to form a sealed outgoing envelope enclosing said reply envelope, said outgoing envelope back sheet having a tear strip across the bottom, through which the message sheet and reply envelope may be extracted; and B) each part of the multipart form having the following aligned areas:

an outgoing envelope return address area, a reply envelope return address area and a postage permit area generally along the top of each part of the multipart form;

an outgoing envelope mail-to address area and a reply envelope mail-to address area generally along a right hand edge below the outgoing envelope return address, reply envelope return address and postage permit areas; and a message area below the outgoing envelope return address, reply envelope return address and postage permit areas and generally to the left of the outgoing and reply envelope mail-to address areas; and C) a series of coatings selectively applied to parts of the multipart form, including:

one or more coatings on a reverse side of the top sheet in the outgoing envelope return address, postage permit and outgoing envelope mail-to address area to imprint outgoing envelope mail-to and return addresses and a postage permit on the face of the outgoing envelope when imprinted by the impact printer on the face of the top sheet;

one or more coatings on a reverse side of the outgoing envelope front sheet in the outgoing and reply envelope mail-to and return address areas and in the message area to imprint information related to the outgoing and reply envelope mail-to and return address areas and the message area on the face of the message sheet when imprinted by the impact printer on the face of the top sheet; and one or more coatings on a reverse side of the message sheet in the reply envelope mail-to and return address areas to imprint the reply envelope mail-to and return addresses on the face of the reply envelope when imprinted by the impact printer on the face of the top sheet, so that information impact printed on top sheet produces an addressed and sealable reply envelope, and a message sheet, removably contained within a sealed and addressed outgoing envelope including a postage permit.

2. The invention of claim 1, wherein each part of the multipart form has an aligned FIM area adjacent the postal permit area and the coatings further comprise:

one or more coatings on the reverse side of the message sheet in the FIM area to selectively produce an FIM mark on the return envelope if imprinted by the impact printer on the face of the top sheet.

3. The invention of claim 2, wherein the flap interacts with one of the fastened sides of the outgoing envelope to properly position the reply envelope mail-to and return address, FIM and postal permit areas on the reply envelope.

4. The invention of claim 1, wherein the flap interacts with one of the fastened sides of the outgoing envelope to properly position the reply envelope mail-to and return address, FIM and postal permit areas on the reply envelope.

5. The invention of claim 1, wherein the message sheet further comprises:

a line of weakness so that a recipient of the outgoing envelope may conveniently separate the message sheet into a record for the recipient including the address of a sender of the outgoing envelope and the message, and a return portion sized to fit within the return envelope and including the address of the recipient.

6. The invention of claim 5, wherein the message sheet further comprises:

a line of weakness so that a recipient of the outgoing envelope may conveniently separate the message sheet into a record for the recipient including the mail-to address of the reply envelope, the message, and a return portion sized to fit within the return envelope including the return address of the reply envelope.

7. The invention of claim 1, wherein the message sheet further comprises:

a line of weakness so that a recipient of the outgoing envelope may conveniently separate the message sheet into a record for the recipient including the mail-to address of the reply envelope, the message, and a return portion sized to fit within the return envelope including the return address of the reply envelope.

8. The invention of claim 1, wherein the message sheet further comprises:

a line of weakness so that a recipient of the outgoing envelope may conveniently separate the message sheet into a record for the recipient including the mail-to address of the reply envelope and/or the return address of the outgoing envelope, the message, and a return portion sized to fit within the return envelope including the mail-to address of the outgoing envelope and/or the return address of the reply envelope.

9. The invention of claim 1, wherein the series of coatings further comprises:

a block out coating on the back of the reply envelope in the reply envelope mail-to address area improving machine scanability of the mail-to address.

10. The invention of claim 9, wherein the block out coating is opaque.

11. The invention of claim 9, wherein the block out coating is solid.

12. The invention of claim 9, wherein the block out coating is dark.

13. The invention of claim 9, wherein the series of coatings further comprises:

a security coating on at least a substantial portion of the back of the reply envelope outside of the reply envelope mail-to area to reduce visibility of contents of the reply envelope after the reply envelope has been mailed.

14. The invention of claim 9, wherein the series of coatings further comprises:

a block out coating on the back of the reply envelope in the reply envelope return address area improving machine scanability of the return address.

15. The invention of claim 14, wherein the block out coating is opaque.

16. The invention of claim 14, wherein the block out coating is solid.

17. The invention of claim 14, wherein the block out coating is dark.

18. The invention of claim 14, wherein the series of coatings further comprises:

a security coating on at least a substantial portion of the back of the reply envelope outside of the reply envelope mail-to area to reduce visibility of contents of the reply envelope after the reply envelope has been mailed.

19. The invention of claim 1, wherein the series of coatings further comprises:

one or more block out coatings on the back of the reply envelope in the reply envelope mail-to and return address areas improving machine scanability of the mail-to and return addresses.

20. The invention of claim 19, wherein the block out coating is opaque.

21. The invention of claim 19, wherein the block out coating is solid.

22. The invention of claim 19, wherein the block out coating is dark.

23. The invention of claim 19, wherein the series of coatings further comprises:

a security coating on at least a substantial portion of the back of the reply envelope outside of the reply envelope mail-to area to reduce visibility of contents of the reply envelope after the reply envelope has been mailed.

24. The invention of claim 2, wherein the series of coatings further comprises:

one or more coatings on the reverse side of the message sheet in the FIM area to selectively produce an FIM mark on the return envelope if imprinted by the impact printer on the face of the top sheet, a block out coating on the back of the reply envelope in the reply envelope FIM area improving machine scanability of the FIM mark.

25. The invention of claim 24, wherein the block out coating is opaque.

26. The invention of claim 25, wherein the block out coating is solid.

27. The invention of claim 26, wherein the block out coating is dark.

* * * * *